US009993740B2

(12) United States Patent
Li et al.

(10) Patent No.: US 9,993,740 B2
(45) Date of Patent: Jun. 12, 2018

(54) VIEWING SYSTEM BASED ON TWO-LAYER FILM AND TELEVISION RAILCAR

(71) Applicant: SHENZHEN OCT VISION INC., Shenzhen, Guangdong (CN)

(72) Inventors: Jian Li, Guangdong (CN); Hongguang Wen, Guangdong (CN); Baoluo Jia, Guangdong (CN)

(73) Assignee: SHENZHEN OCT VISION INC., Shenzhen (CN)

( * ) Notice: Subject to any disclaimer, the term of this patent is extended or adjusted under 35 U.S.C. 154(b) by 67 days.

(21) Appl. No.: 15/108,580

(22) PCT Filed: Dec. 17, 2014

(86) PCT No.: PCT/CN2014/094018
§ 371 (c)(1),
(2) Date: Jun. 28, 2016

(87) PCT Pub. No.: WO2015/101180
PCT Pub. Date: Jul. 9, 2015

(65) Prior Publication Data

US 2016/0317943 A1 Nov. 3, 2016

(30) Foreign Application Priority Data

Dec. 30, 2013 (CN) ..... 2013 1 0742342

(51) Int. Cl.
*A63J 25/00* (2009.01)
*A63G 31/16* (2006.01)
*A63G 31/02* (2006.01)

(52) U.S. Cl.
CPC ..... *A63J 25/00* (2013.01); *A63G 31/02* (2013.01); *A63G 31/16* (2013.01)

(58) Field of Classification Search
CPC ..... A63G 31/16; A63G 31/00; A63G 31/06; A63G 1/00; A63G 1/10; A63G 19/00;
(Continued)

(56) References Cited

U.S. PATENT DOCUMENTS 4,885,878 A * 12/1989 Wuu ..... E04H 3/126 348/121
5,114,154 A * 5/1992 Sellner ..... A63H 5/04 273/367

(Continued)

FOREIGN PATENT DOCUMENTS

CN 2367365 Y 3/2000
CN 202155056 U 3/2012

OTHER PUBLICATIONS

1st Office Action of counterpart Chinese Patent Application No. 201310742342.6 dated Mar. 30, 2015.

*Primary Examiner* — Jason C Smith

(57) ABSTRACT

A viewing system based on a two-layer film and television railcar, comprising a first railcar moving on a first rail track and a second railcar of a second rail track arranged thereabove; at the docking point of the first railcar and the second railcar, the first rail track and the second rail track are positioned on the same plane; and arranged on the bottom of the first railcar is a locking apparatus used for locking the first railcar onto the second rail track when the first railcar moves on the second rail track. Viewers can experience different viewing positions and viewing space by means of the first railcar and the second railcar, and can use the changing movement of the railcars to enjoy different film and television content.

4 Claims, 2 Drawing Sheets

(58) Field of Classification Search
CPC .. A63G 19/30; G09B 9/00; G09B 9/12; A63J 25/00
See application file for complete search history.

(56) References Cited

U.S. PATENT DOCUMENTS 6,017,276 A * 1/2000 Elson ..... A63G 31/16 434/29
6,053,576 A * 4/2000 Jessee ..... A63G 31/16 297/232
6,095,926 A * 8/2000 Hettema ..... A63G 31/16 104/85
6,533,670 B1 * 3/2003 Drobnis ..... A63G 31/16 434/55
6,561,502 B1 * 5/2003 Flickner ..... B43M 3/04 270/58.06
6,665,985 B1 * 12/2003 Hennes ..... E04H 3/22 352/69
7,033,177 B2 * 4/2006 Kim ..... G09B 9/12 434/29
7,094,157 B2 * 8/2006 Fromyer ..... A63G 31/12 434/55
8,453,579 B2 * 6/2013 Nemeth ..... A63G 3/00 104/53
8,641,540 B2 * 2/2014 Feuer ..... A63G 7/00 434/55
9,084,941 B1 * 7/2015 Fram ..... A63G 31/16
9,272,224 B2 * 3/2016 Nemeth ..... A63G 7/00
9,731,217 B2 * 8/2017 Li ..... A63J 5/12
9,757,658 B1 * 9/2017 Kaufmann ..... A63G 31/16
2005/0014566 A1 * 1/2005 Hashimoto ..... A63G 31/16 472/59
2005/0014567 A1 * 1/2005 Li ..... A63G 31/16 472/60
2013/0144468 A1 * 6/2013 Foster ..... B62D 3/00 701/2
2015/0065260 A1 * 3/2015 Beyr ..... A63G 31/16 472/60
2016/0271503 A1 * 9/2016 De-Gol ..... A63J 25/00
2016/0317942 A1 * 11/2016 Li ..... A63G 31/16
2016/0317943 A1 * 11/2016 Li ..... A63G 31/16
2016/0325201 A1 * 11/2016 Li ..... A63G 31/16
2017/0072327 A1 * 3/2017 Wach ..... A63G 31/16
2017/0080353 A1 * 3/2017 Li ..... A63J 5/12
2017/0113150 A1 * 4/2017 Lee ..... A63F 13/28
2017/0266572 A1 * 9/2017 Petrov ..... A63G 31/16

* cited by examiner

VIEWING SYSTEM BASED ON TWO-LAYER FILM AND TELEVISION RAILCAR

TECHNICAL FIELD

The present disclosure relates generally to a viewing system, and more particularly, to a viewing system based on a two-layer film and television railcar.

BACKGROUND

In the prior art, a viewing platform of a viewing system is generally fixedly arranged, that is, the audience is seated on his seat for watching the film and television frames broadcasted in front of himself. Such viewing approach is obviously too monotonous. The viewing range and viewing space are limited, as the audience can only watch from different angles at the same location, but cannot move to other locations for watching.

Therefore, the prior art has yet to be improved and developed.

SUMMARY

The object of the present application is to provide a viewing system based on a two-layer film and television railcar, aiming at the defects of the prior art that the viewing platform of the prior viewing system cannot move along a rail track.

In one aspect, a viewing system based on a two-layer film and television railcar is provided, which comprising a first railcar moving on a first rail track and a second railcar with a second rail track arranged thereabove. At a docking point of the first railcar and the second railcar, the first rail track and the second rail track are positioned on a same plane. A locking apparatus is arranged on a bottom of the first railcar for locking the first railcar onto the second rail track when the first railcar moves on the second rail track.

In one embodiment of the viewing system based on a two-layer film and television railcar, the second railcar is provided with a sensing device for sensing the first railcar.

In one embodiment of the viewing system based on a two-layer film and television railcar, the first railcar is provided with several rows of viewing seats.

In one embodiment of the viewing system based on a two-layer film and television railcar, the viewing seats are provided with a driving device for controlling the viewing seats implementing a six degree of freedom movement.

The audience can experience different viewing positions and viewing space by means of the first railcar and the second railcar, and can use the changing movement of the railcars to enjoy different film and television content, through the arrangements of locating first rail track and the second rail track on a same plane at a docking point of the first railcar and the second railcar, and arranging a locking apparatus on the bottom of the first railcar for locking the first railcar onto the second rail track when the first railcar moves on the second rail track.

DETAILED DESCRIPTION OF THE PREFERRED EMBODIMENT

The present application relates to a viewing system based on a two-layer film and television railcar. These and other advantage, aspect and novel features of the present invention, as well as details of an illustrated embodiment thereof, will be more fully understand from the following description and drawings. While various embodiments of the present invention has been presented by way of example only, and not limitation.

Figure 1:
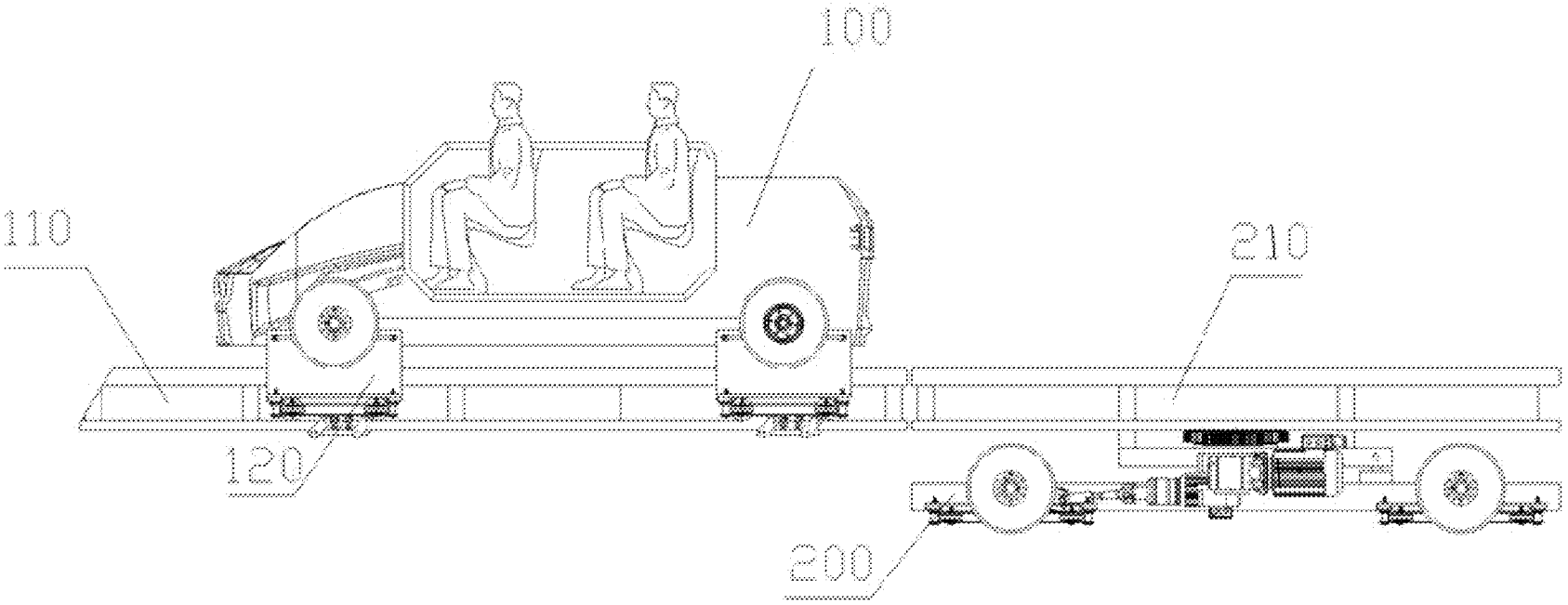
FIG. 1 shows a first state structure of the viewing system based on a two-layer film and television railcar according to a preferable embodiment of the present application.
Figure 2:
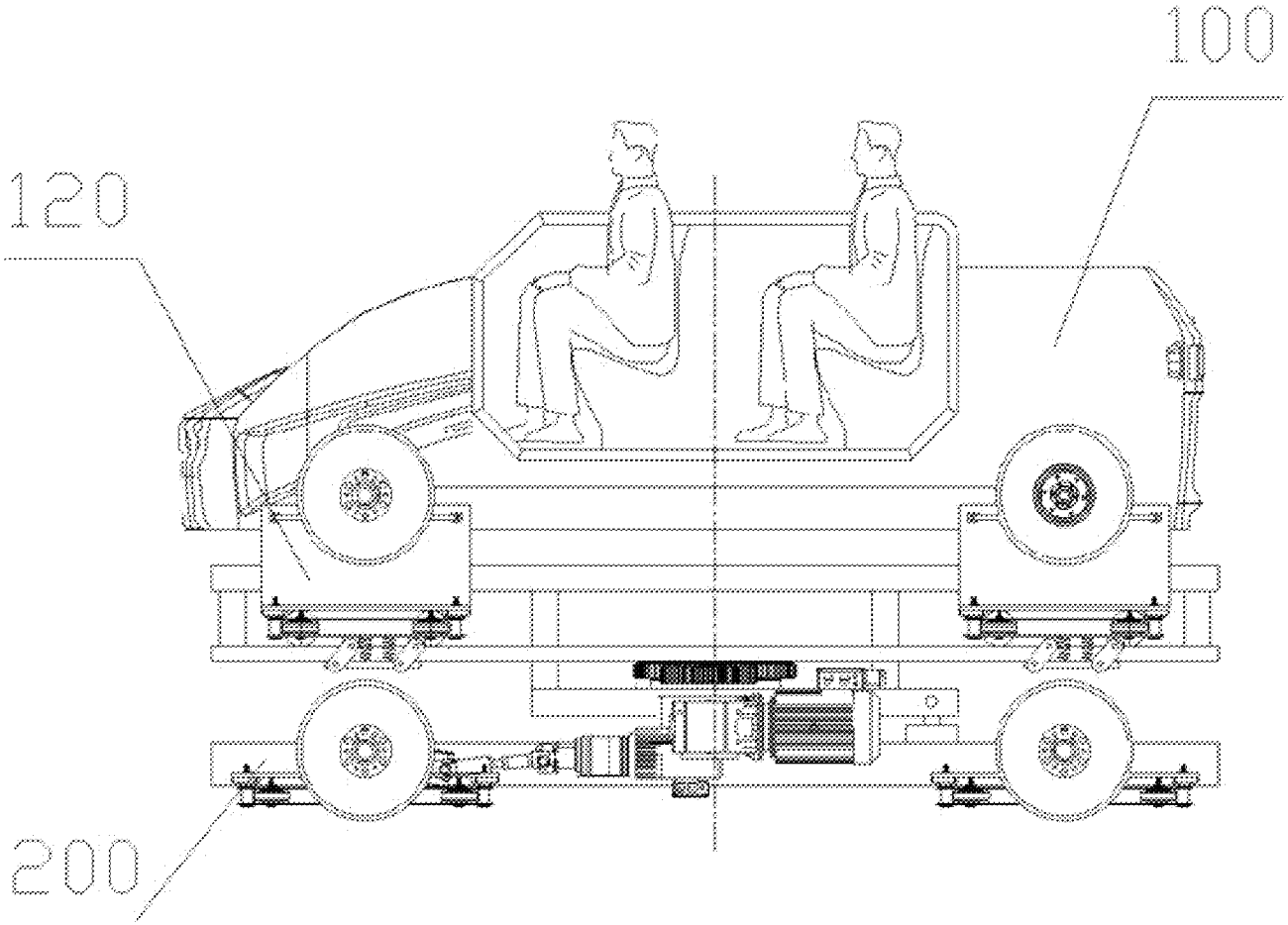
FIG. 2 shows a second state structure of the viewing system based on a two-layer film and television railcar according to a preferable embodiment of the present application.

FIG. 1 shows a first state structure of the viewing system based on a two-layer film and television railcar according to a preferable embodiment of the present application. As shown in FIG. 1, the viewing system based on a two-layer film and television railcar comprises a first railcar 100 moving on a first rail track 110 and a second railcar 200 with a second rail track 210 arranged thereabove. At a docking point of the first railcar 100 and the second railcar 200, the first rail track 110 and the second rail track 210 are positioned on a same plane, such that the first railcar 100 can be transited to the second rail track 210 smoothly. A locking apparatus 120 is arranged on the bottom of the first railcar 100 for locking the first railcar 100 onto the second rail track 210 when the first railcar 100 moves on the second rail track 210.

When the first railcar 100 moves on the second rail track 210, the locking apparatus 120 fixes the first railcar 100 on the second rail track 210. The second railcar 200 drives the above first railcar 100 to move integrally. In such a way, the audience can experience different viewing positions and viewing space by means of the first railcar 100 and the second railcar 200, and can use the changing movement of the railcars to enjoy different film and television content. When the second railcar 200 moves to the first rail track 110, the locking apparatus 120 unlocks the first railcar 100, such that the first railcar 100 can move on the first rail track 110 again.

Furthermore, the second railcar 200 is provided with a sensing device for sensing the location of the first railcar 100. The location of the first railcar 100 is sensed by the sensing device to control the locking and unlocking of the locking apparatus 120.

Furthermore, the first railcar 100 is provided with several rows of viewing seats. For example, the viewing seats are arranged in two rows which are spaced with each other in a predetermined distance. Each row can have three or five viewing seats. For example, each row can have three viewing seats, and the distance between the neighbor rows is 0.5 meters. Each row of the viewing seats has a total width of 2 meters. Of course, the viewing seats can also be arranged in different numbers of rows, all of these arrangements belong to the protection scope of the present application.

Furthermore, the viewing seats are provided with a driving device for controlling the viewing seats implementing a six degree of freedom movement. So that when the audience is sitting on the viewing seat, the driving device can drive the viewing seat to implement actions such as a forward action, a backward action, an upward action, a downward action and so on, according to the content of the film and television.

Furthermore, both the first railcar 100 and the second railcar 200 can implement various stunt actions along their respective rail track. Of course, a corresponding first driving device is needed for drive the first railcar to complete a pitching, swing, acceleration, deceleration, braking and stopping action, and a second driving device is needed for drive the second railcar to complete a pitching, swing, acceleration, deceleration, braking and stopping action.

During the operation of the present application, when the audience sitting in the first railcar pulls down the safety pressure lever, the first railcar implements various stunt actions such as a pitching, swing, rotation, acceleration, deceleration, braking and stopping action, along the first rail track 110 according to the content of the film and television. When the first railcar moves to the second rail track, the locking apparatus locks the first railcar on the second rail track, and then the second railcar moves in a high speed, thus giving the audience a rapid experience. When the second railcar marches to the docking point, the audience can get off. In the present application, the running speed of the second railcar is much greater than the running speed of the first railcar. The first railcar mainly completes various stunt actions, and the second railcar can complete a high speed travel.

The first railcar is provided with a synchronous mechanism which controls the first railcar to implement a synchronous action according to the film and television frame shown by the screens arranged at two sides of the first rail track, such as controlling the first railcar to implement above pitching, swing, rotation, acceleration, deceleration, braking and stopping actions, thus making the audience feel immersive. The synchronous mechanism further controls the first railcar to implement a synchronous action according to the action in the shown film and television frame. For example, when the current frame swings up and down, or left and right, the synchronous mechanism controls the first railcar to make a same action synchronously with a same amplitude and frequency.

When the first railcar moves on the second rail track, the second railcar moves in a high-speed integrally on a rail track below itself.

To sum up, the audience can experience different viewing positions and viewing space by means of the first railcar and the second railcar, and can use the changing movement of the railcars to enjoy different film and television content, through the arrangements of locating first rail track and the second rail track on a same plane at a docking point of the first railcar and the second railcar, and arranging a locking apparatus on the bottom of the first railcar for locking the first railcar onto the second rail track when the first railcar moves on the second rail track.

It should be noted that, the present application is not limited to above embodiments. Alternative modification and change will become apparent to those skilled in the art to which the present application pertains without departing from its spirit and scope.

What claimed is:

1. A viewing system based on a two-layer railcar for film and television watching comprising a first railcar moving on a first rail track and a second railcar with a second rail track arranged thereabove, wherein at a docking point of the first railcar and the second railcar, the first rail track and the second rail track are positioned on a same plane, wherein a locking apparatus is arranged on a bottom of the first railcar for locking the first railcar onto the second rail track when the first railcar moves on the second rail track.

2. The viewing system based on a two-layer railcar for film and television watching according to claim 1, wherein the second railcar is provided with a sensing device for sensing the first railcar.

3. The viewing system based on a two-layer railcar for film and television watching according to claim 1, wherein the first railcar is provided with several rows of viewing seats.

4. The viewing system based on a two-layer railcar for film and television watching according to claim 3, wherein the viewing seats are provided with a driving device for controlling the viewing seats implementing a six degree of freedom movement.

* * * * *